US009290291B2

(12) United States Patent
Hamdoun et al.

(10) Patent No.: US 9,290,291 B2
(45) Date of Patent: Mar. 22, 2016

(54) PACKAGES FOR TOOTH TREATMENT PRODUCTS

(71) Applicant: The Procter & Gamble Company, Cincinnati, OH (US)

(72) Inventors: Karim Hamdoun, Loveland, OH (US); Martin Jay Marotti, Carmel, IN (US)

(73) Assignee: THE PROCTER & GAMBLE COMPANY, Cincinnati, OH (US)

( * ) Notice: Subject to any disclaimer, the term of this patent is extended or adjusted under 35 U.S.C. 154(b) by 0 days.

(21) Appl. No.: 14/552,908

(22) Filed: Nov. 25, 2014

(65) Prior Publication Data

US 2015/0144510 A1 May 28, 2015

Related U.S. Application Data

(60) Provisional application No. 61/908,880, filed on Nov. 26, 2013.

(51) Int. Cl.

| | |
|---|---|
| ***A61B 19/02*** | (2006.01) |
| ***B65D 5/38*** | (2006.01) |
| ***B65D 5/42*** | (2006.01) |
| ***B65D 5/44*** | (2006.01) |
| ***B65D 85/00*** | (2006.01) |
| ***B65D 6/06*** | (2006.01) |
| ***B65D 25/54*** | (2006.01) |
| ***B65D 77/04*** | (2006.01) |

(52) U.S. Cl.

CPC ..... *B65D 5/38* (2013.01); *B65D 5/4204* (2013.01); *B65D 5/443* (2013.01); *B65D 7/10* (2013.01); *B65D 9/08* (2013.01); *B65D 11/12* (2013.01); *B65D 25/54* (2013.01); *B65D 77/0413* (2013.01); *B65D 77/0433* (2013.01); *B65D 85/70* (2013.01)

(58) Field of Classification Search

CPC ..... B65D 5/38

USPC ..... 206/461, 468, 467, 463, 464, 465, 470, 206/471, 775, 776, 778, 368, 63.5, 769, 206/771, 772, 770, 758, 782

See application file for complete search history.

(56) References Cited

U.S. PATENT DOCUMENTS

| | | | | |
|---|---|---|---|---|
| 3,487,915 | A * | 1/1970 | Scott | 206/461 |
| 4,180,165 | A | 12/1979 | Kuchenbecker | |
| 4,739,353 | A | 4/1988 | Heuer et al. | |
| 5,602,612 | A * | 2/1997 | Angeli et al. | 396/535 |
| 5,775,494 | A * | 7/1998 | Taplin | 206/308.2 |
| 6,360,893 | B1 | 3/2002 | Lowe | |
| 6,401,932 | B1 * | 6/2002 | Weinstein et al. | 206/779 |
| 6,588,596 | B1 * | 7/2003 | Holmes et al. | 206/778 |
| 6,659,271 | B2 * | 12/2003 | Parsons | 206/232 |
| 7,533,774 | B2 * | 5/2009 | Zimmerman | 206/784 |
| 7,708,142 | B2 | 5/2010 | Ehrlund | |

(Continued)

OTHER PUBLICATIONS

International Search Report and Written Opinion, mail date Mar. 9, 2015, 9 pages.

*Primary Examiner* — Jacob K Ackun
*Assistant Examiner* — Jenine Pagan
(74) *Attorney, Agent, or Firm* — James E. Oehlenschlager

(57) ABSTRACT

A package for a tooth treatment product is disclosed. The package includes an inner container and an outer sleeve having at least one open end for receiving the inner container, the outer sleeve including a window through which the tooth treatment product is visible to a consumer.

10 Claims, 9 Drawing Sheets

(56) References Cited

U.S. PATENT DOCUMENTS

| | | | | |
|---|---|---|---|---|
| 8,573,397 | B1 * | 11/2013 | Fager et al. | 206/469 |
| 8,936,158 | B2 * | 1/2015 | Salow et al. | 206/758 |
| 8,955,671 | B1 * | 2/2015 | Barnett | 206/1.5 |
| 2007/0209956 | A1 | 9/2007 | Perkins-Stanaford et al. | |
| 2008/0245677 | A1 | 10/2008 | Sagel | |
| 2010/0155277 | A1 * | 6/2010 | Koch | 206/320 |
| 2011/0100847 | A1 * | 5/2011 | Ruth | 206/320 |
| 2011/0132779 | A1 | 6/2011 | Loughman et al. | |

* cited by examiner

PACKAGES FOR TOOTH TREATMENT PRODUCTS

FIELD OF THE INVENTION

The present disclosure relates to product packaging for a tooth treatment product. More particularly, the present disclosure relates to a package assembly having a slidable tray section for holding and displaying tooth treatment products.

BACKGROUND OF THE INVENTION

There is a wide variety of commercially available product packaging. In many cases, the packages are designed to meet specific functional requirements. For example, the packages may be designed to meet certain size constraints, certain shelf-life or specific product protection criteria.

Packages may also be designed such that the outside of the package is used to communicate to the consumer. For example, the outside of the package may be printed to provide product information such as product ingredients to the consumer. Additionally, the outside surface of the packages may contain artwork, trademarks and other information to assist in marketing the product contained within the package.

However, there remains a continuous need for new packages that provide improved balance between both functional requirements and marketing and communication requirements.

SUMMARY OF THE INVENTION

According to one embodiment, a package for a tooth treatment product is provided. The package includes an inner container having a front face section and a back face section, the front face section including a recess portion therein for containing the tooth treatment product; a cover joined to the front face section of the inner container, the cover having a height less than the corresponding height of the recess portion of the inner container, the difference in height defining a ridge between a top side of the cover and the recess portion; an outer sleeve having at least one open end for receiving the inner container, the outer sleeve including a window through which the tooth treatment product is visible to a consumer; and a stop tab provided adjacent the at least one open end of the outer sleeve and configured to releasably engage the ridge. The inner container is removable through the at least one open end of the outer sleeve by disengaging the stop tab from the ridge.

These and other features, aspects and advantages of specific embodiments will become evident to those skilled in the art from a reading of the present disclosure.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements and wherein:

DETAILED DESCRIPTION OF THE INVENTION

Figure 1:
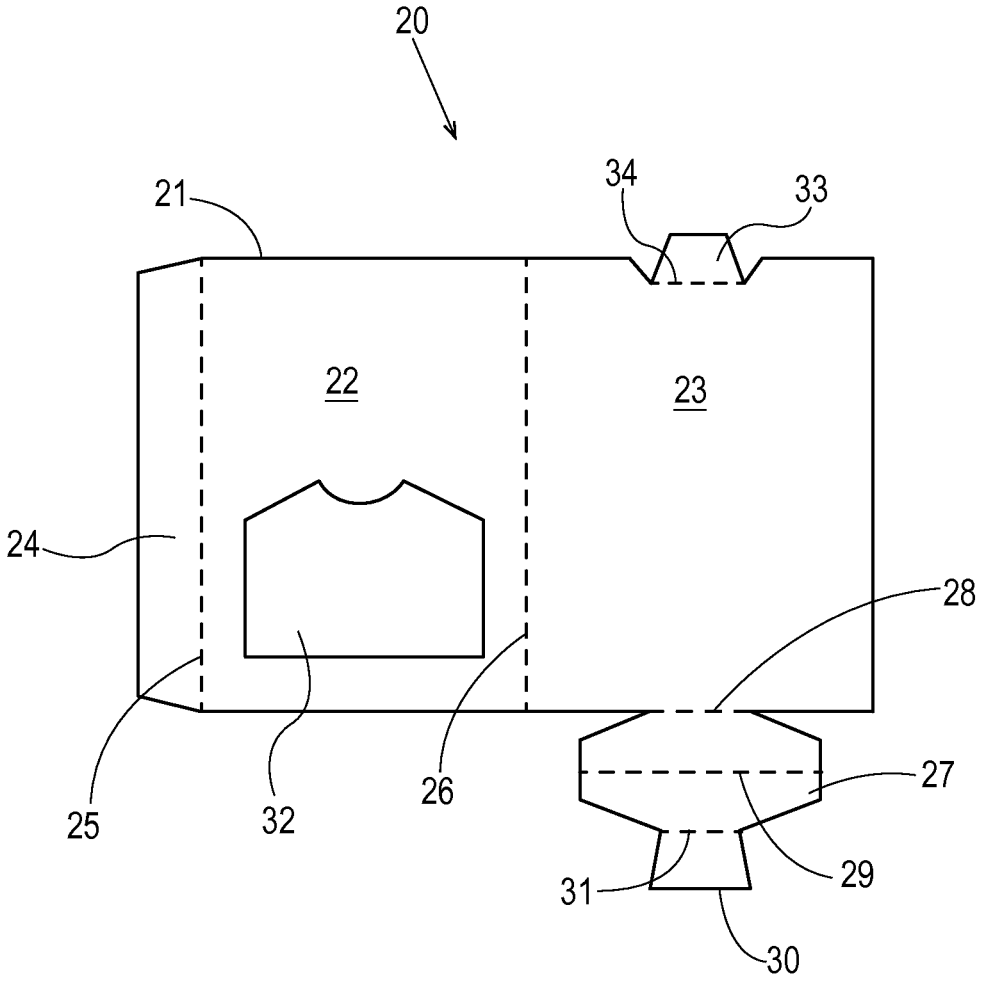
FIG. 1 is a top view of a disassembled outer sleeve of a package according to one or more embodiments illustrated and described herein.

The following text sets forth a broad description of numerous different embodiments of the present disclosure. The description is to be construed as exemplary only and does not describe every possible embodiment. It will be understood that any feature, characteristic, component, composition, ingredient, product, step or methodology described herein can be deleted, combined with or substituted for, in whole or part, any other feature, characteristic, component, composition, ingredient, product, step or methodology described herein. Numerous alternative embodiments could be implemented, using either current technology or technology developed after the filing date of this patent, which would still fall within the scope of the claims. All publications and patents cited herein are incorporated herein by reference.

According to the present disclosure, there is described a package for a tooth treatment product having a sleeve and an inner container intended to hold the tooth treatment product. Although the embodiments are described herein in the context of a package for a tooth treatment product, such as a strip of material for the delivery of an oral care substance, embodiments are not limited thereto. The term "tooth treatment product" is intended to refer to an article comprising an oral care substance which can be manually applied to the surfaces of the teeth. In some embodiments, the tooth treatment product includes a barrier layer, to which the oral care substance is applied, for delivering the oral care substance to the surfaces of one or more teeth. The barrier layer includes, but is not limited to, a strip of material. In another embodiment, the tooth treatment product can be deposited on a release liner.

Integral with, applied to or coated on to a strip of material is an "oral care substance", which in certain embodiments may be a homogeneous fluid, uniformly and continuously coated onto the strip of material. However, the oral care substance may alternatively be a laminate or separated layers of components, an amorphous mixture of components, separate stripes or spots or other patterns of different components, or a combination of these structures including a continuous coating of oral care substance along a longitudinal axis of a portion of a strip of material. The oral care substance may contain or is itself an active, such as a composition, compound, or mixture capable of influencing or effecting a desired change in appearance and/or structure of the surface it contacts. Example actives include: oxalic acid, potassium salts of oxalic acid, hydrogen peroxide, carbamide peroxide, sodium fluoride, sodium monofluorophosphate, pyrophosphate, chlorhexidine, polyphosphate, triclosan, and enzymes. Examples of appearance and structural changes include, but are not necessarily limited to: desensitizing, whitening, stain bleaching, stain removal, remineralization to form fluorapatite, plaque removal, and tartar removal.

Embodiments disclosed herein may be utilized for other additional oral care products, for example, dentifrice, floss, concentrated mouth rinse, concentrated toothpaste, solid dentifrice, denture adhesive, chewing gum, and many others.

By "oral condition" as used herein is meant diseases or conditions of the oral cavity including caries, plaque, sensititvity, breath malodor, dental erosion, gingivitis, and periodontal disease.

As used herein, the phrase "oral care active" is intended to refer to any material that is safe for use in the oral cavity that provides changes to the overall health of the oral cavity, and specifically the condition of the oral surfaces the oral care substance contacts.

Referring now to FIG. 1, an outer sleeve 20 of a package for a tooth treatment product may be formed from a flat, one-piece blank 21. In certain embodiments, the blank is formed into a sleeve 20 by folding and gluing. The blank 21 may include a series of panels including a front panel 22, a back panel 23, and a side panel 24. The panels are hinged one to the next in series along fold lines 25 and 26. The blank 21 may also include a bottom panel 27, hinged to the back panel 23, along fold line 28. In certain embodiments, the bottom panel 27 may include an additional fold line 29 in order to provide flexibility to bottom panel 27. The bottom panel 27 further includes a flap 30 and fold line 31 for folding and attaching bottom panel 27 to front panel 22 by means of flap 30 when formed into sleeve 20.

The sleeve 20 may be made from cardboard, paperboard, corrugated cardboard, cartonboard, paper, card stock, mixtures or combinations thereof, or any other foldable sheet material. As used herein, the term "sleeve" means a hollow member having substantially fixed dimensions, for example as compared to a rubber band which has flexible dimensions, with at least one open end, and having any cross-sectional shape, including, for example, triangular, square, rectangular, pentagonal, hexagonal, heptagonal, octagonal and circular.

As shown in FIG. 1, the sleeve 20 may include at least one window 32 defined therein to permit a visual inspection of the contents of the package 10 therethrough. In one embodiment, window 32 may have one or more regions of transparency. As used herein, "transparency" means having the property of transmitting light without substantial scattering so that items lying beyond can be visible to a person. In certain embodiments, the window 32 may include a transparent covering, such as, for example, a transparent film. In another embodiment, window 32 may include an opening in sleeve 20 that does not include a covering.

Exemplary materials from which the window 32 may be made include, but are not limited to, polypropylene (PP), polyethylene (PE), polycarbonate (PC), polyamides (PA), polyethylene terephthalate (PETE), polyvinylchloride (PVC), general purpose polystyrene (GPPS), and polystyrene (PS). The transparent material used to fabricate window 32 may also be used to fabricate the remainder of sleeve 20 (not including window 32), in certain embodiments the material comprising the remainder of the sleeve 20 may be colored, tinted, frosted, shaded, or patterned to cause sleeve 20 to be opaque or not generally transparent. The material comprising window 32 may also be colored, tinted, frosted, shaded, or patterned just as long as window 32 is still generally transparent such that tooth treatment product 200 is visible through window 32 from outside package 10.

In FIG. 1, window 32 is shown as having a generally trapezoidal shape. However, it is understood that window 32 may comprise a variety of shapes, sizes, and configurations, including but not limited to any geometric shapes, non-geometric shapes, patterns, slits, etc., as known to one of ordinary skill in the art.

As further shown in FIG. 1, sleeve 20 may also include a stop tab 33 and fold line 34 positioned at the open end of the outer sleeve 20. Stop tab 33 is configured to bring about locking of an inner container in the sleeve 20, which is described in greater detail below. As can be seen in FIG. 1, stop tab 33 has an essentially trapezoidal shape. However, stop tab 33 may have any shape other than trapezoidal, including triangular, square, rectangular, pentagonal, hexagonal, heptagonal and octagonal. In one embodiment, stop tab 33 includes a flap integrally formed on one of the panels of the outer sleeve.

Figure 2:
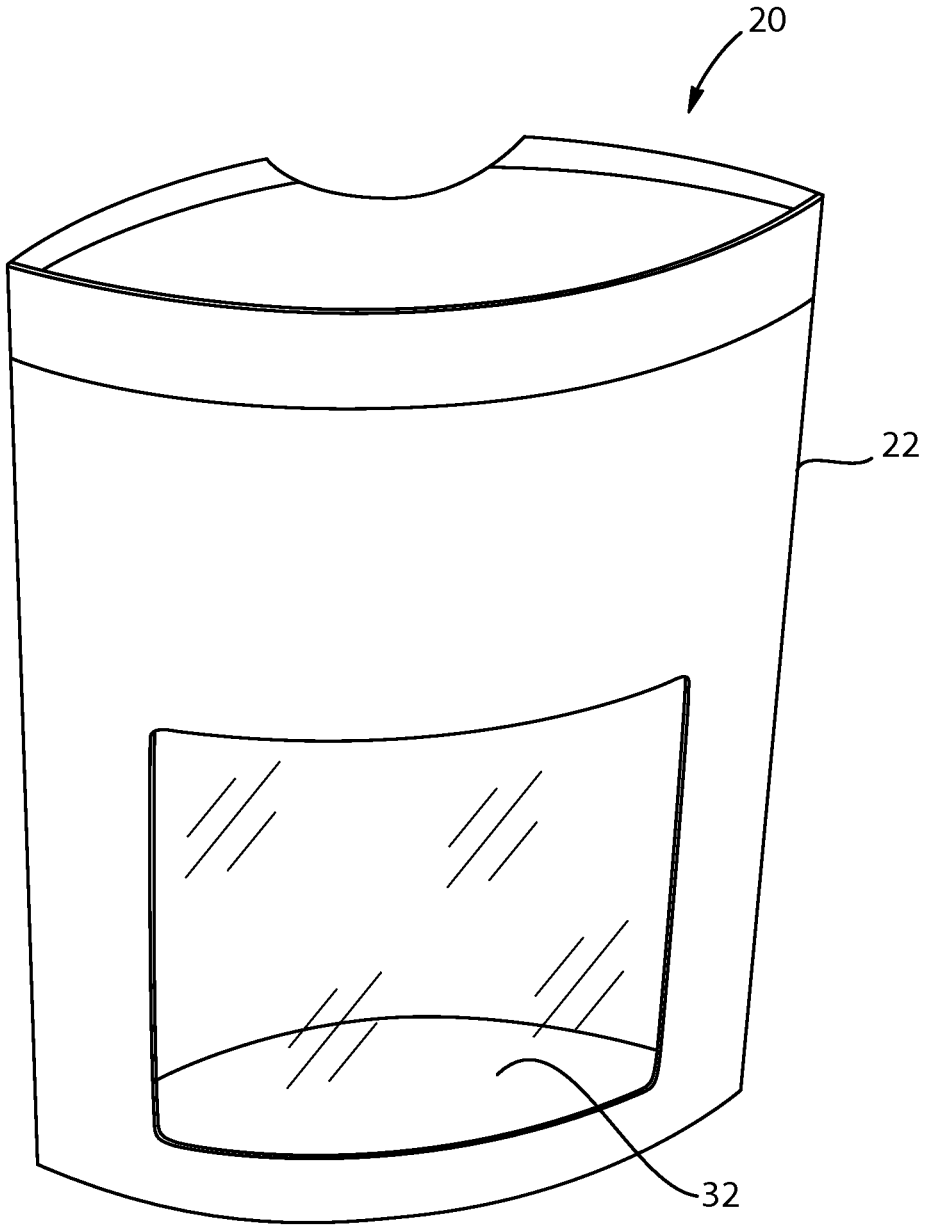
FIG. 2 is a perspective view of the outer sleeve in an assembled state according to one or more embodiments illustrated and described herein.

In order to assemble the outer sleeve 20, the blank 21 is folded along fold line 26, the side panel 24 is folded along fold line 25 and joined to the back panel 23 in any conventionally known manner. Next, bottom panel 27 is attached to the front panel 22 by folding flap 30 along fold line 31 and joining it to front panel 22 in any conventionally known manner. As a result, blank 21 is formed into outer sleeve 20 as shown in FIG. 2.

Figure 3:
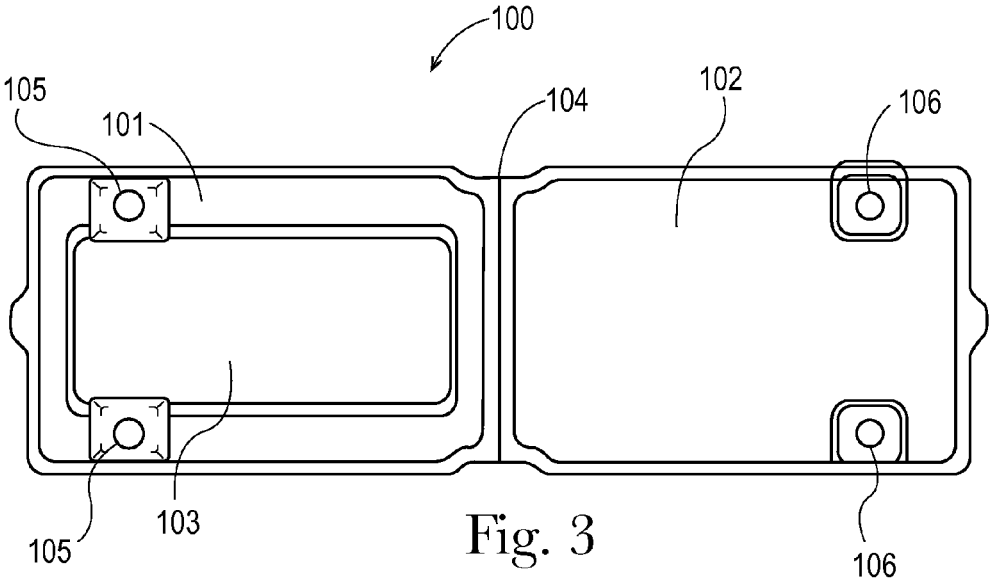
FIG. 3 is a top view of of an unfolded inner container according to one or more embodiments illustrated and described herein.
Figure 4:
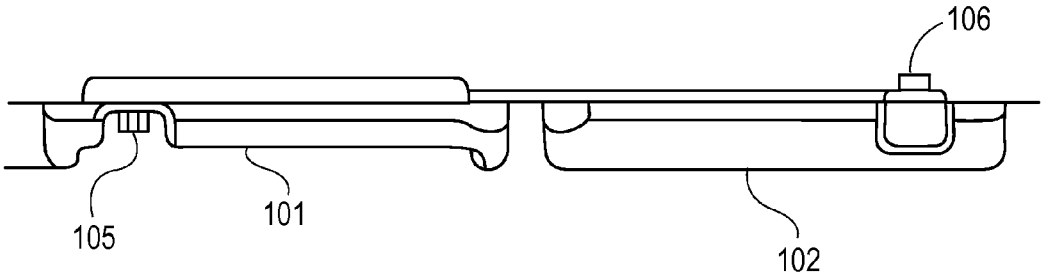
FIG. 4 is a side view of the inner container shown in FIG. 3 according to one or more embodiments illustrated and described herein.

Referring now to FIGS. 3 and 4, an inner container 100 is shown. According to one embodiment, inner container 100 may include at least two sections which may be folded with respect to one another. As shown in FIG. 3, the inner container 100 may include a front face section 101 having a recess 103 therein for receiving the tooth treatment product 200. Adjacent the front face section 101, a back face section 102 may be positioned. As shown, the front face section 101 and the back face section 102 may be integrally joined with one another along hinged fold line 104. However, in certain embodiments, the front face section 101 and the back face section 102 may be discrete from one another.

Still referring to FIG. 3, the front face section 101 may include one or more receiving areas 105, while the back face section 102 may include one or more engagement areas 106. When assembled, the engagement areas 106 engage the receiving areas 105. The outer surface of the engagement areas 106 may form an interference fit with the inner surface of the receiving areas 105 when brought into contact by folding of the front face section 101 and back face section 102. The interaction between the engagement areas 106 and the receiving areas 105 can help align the front face section 101 and the back face section 102. Additionally, the interference fit between the engagement areas 106 and the receiving areas 105 help maintain the inner container 100 in a closed position. The engagement areas 106 or receiving areas 105 may be positioned in any suitable location. For example, receiving areas 105 may be positioned adjacent an outer edge of the front face section 101, in order to avoid interference with the recess 103.

In certain embodiments, the inner container 100 can be made of relatively stiff materials, such as, for example, cardboard, paperboard, cartonboard, chipboard, plywood, SBS, metal, plastic, paper, card stock, fabric, ceramic, rigid foams—such as expanded polystyrene, polymer, natural or synthetic fibers, webs, mesh, screen, composite, mixtures or combinations thereof, or any other suitable material. Alternatively, or in addition, the inner container 100 can be made of a flexible material, such as, blown or cast film in a blend of low density polyethylene and linear low density polyethylene, metallocenes, ethylene vinyl acetate, surlyn, polyethylene terephthalate, biaxially oriented polypropylene, nylon, combinations thereof, or any suitable material. In another embodiment, the inner container 100 may be comprised of a transparent plastic. Suitable plastics may be selected, for example, from among polymers and copolymers of ethylene, propylene, butane, butadiene, polystyrenes, acetates, butyrates, propionates and vinyls, as well as others.

Figure 5:
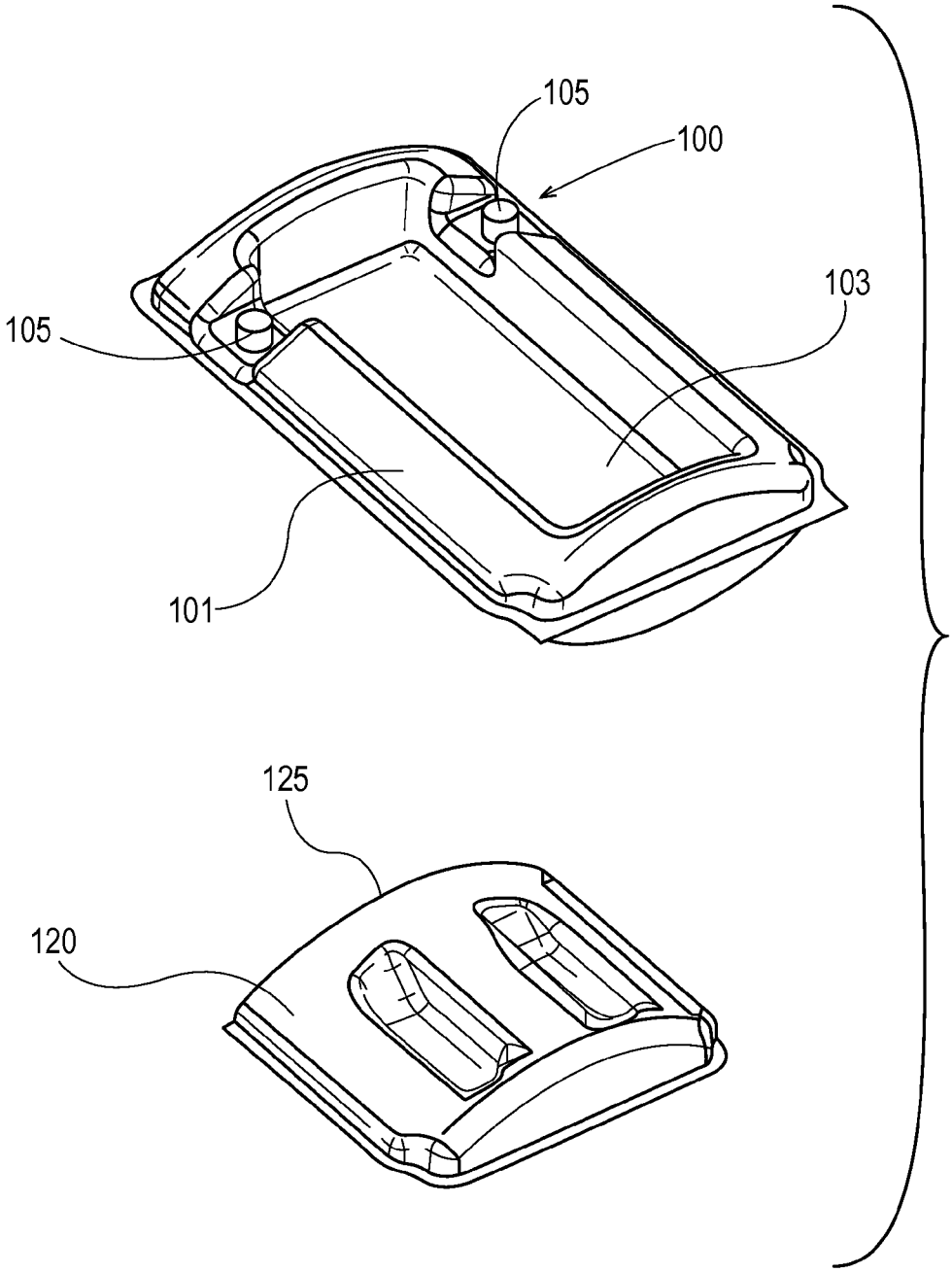
FIG. 5 is an exploded view of a cover and inner container according to one or more embodiments illustrated and described herein.
Figure 6:
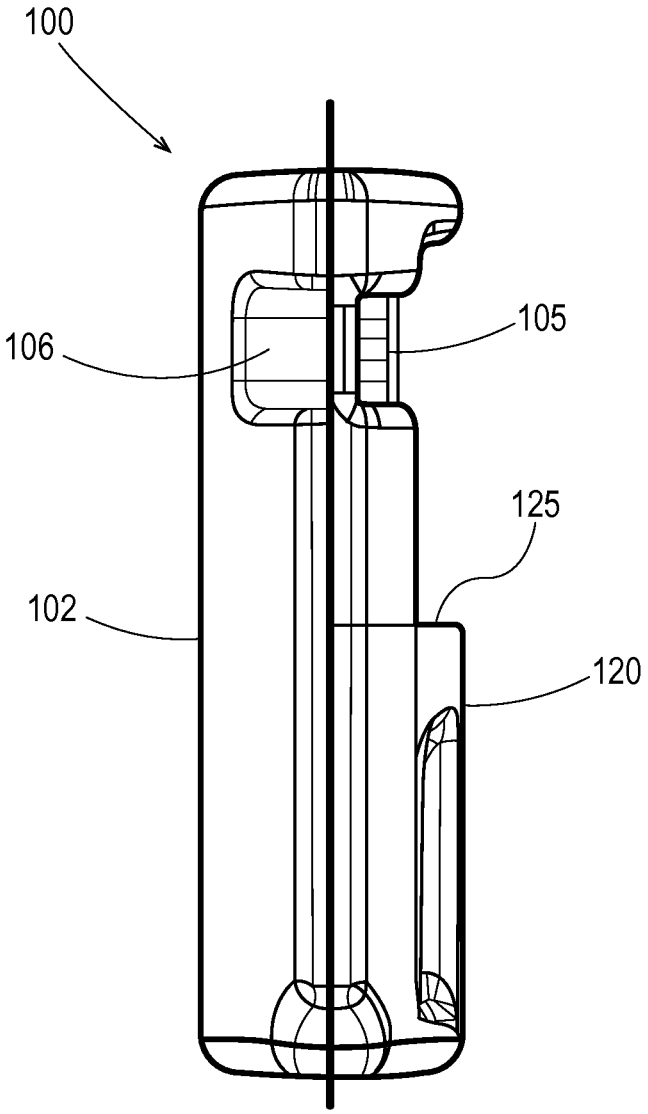
FIG. 6 is a side view of the cover attached to the inner container in an assembled state according to one or more embodiments illustrated and described herein.

As shown in FIG. 5 and FIG. 6, in certain embodiments the inner container 100 may include a removable cover 120 for at least partially covering recess 103 in order to secure and protect the tooth treatment product 200 disposed within the recess 103. The cover 120 may be configured to attach to or engage with front face section 101 of inner container 100 in order to provide some resistance to the separation of the cover 120 and the inner container 100. As shown in FIG. 6, the cover 120 has a height that is less than the height of the inner container 100 for at least partially covering recess 103, while the width of the cover 120 and the width of the inner container 100 is approximately the same. In another embodiment, the cover 120 has a height that is less than the height of the recess 103, while the width of the cover 120 is greater than the width of the recess 103. The difference in height between the cover 120 and the inner container 100 or the recess 103, define a ridge 125 between a portion of the cover 120 and the recess 103. The cover 120 may be formed from a transparent material. However, it is within the scope of the present disclosure for the cover 120 to be formed from any other suitable material.

Figure 7:
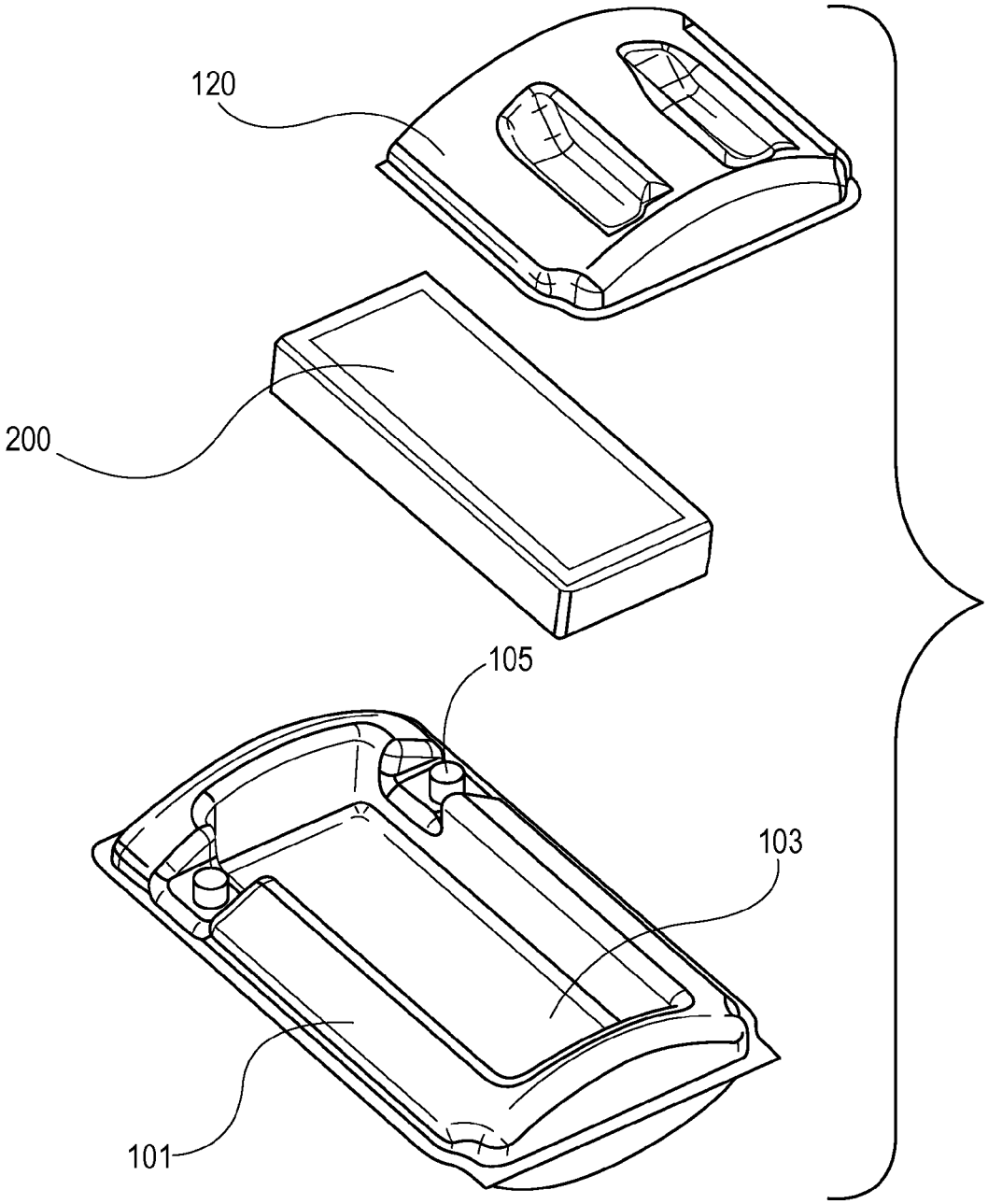
FIG. 7 is an exploded view of a cover, tooth treatment product and inner container according to one or more embodiments illustrated and described herein.
Figure 8:
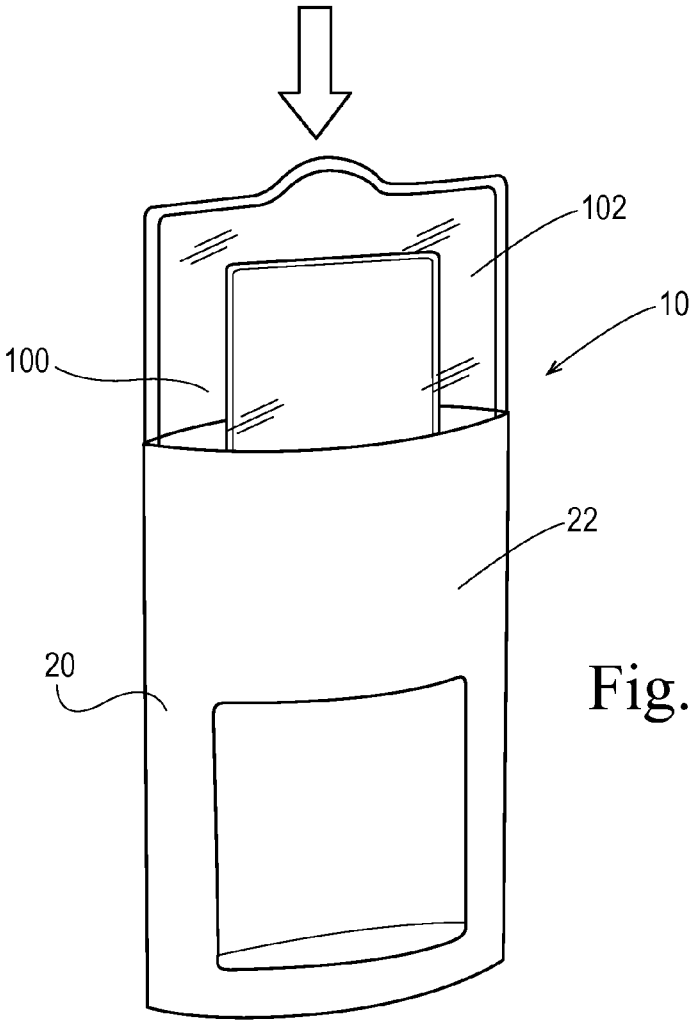
FIG. 8 is a perspective view of the inner container and cover partially inserted into the outer sleeve according to one or more embodiments illustrated and described herein.
Figure 9:
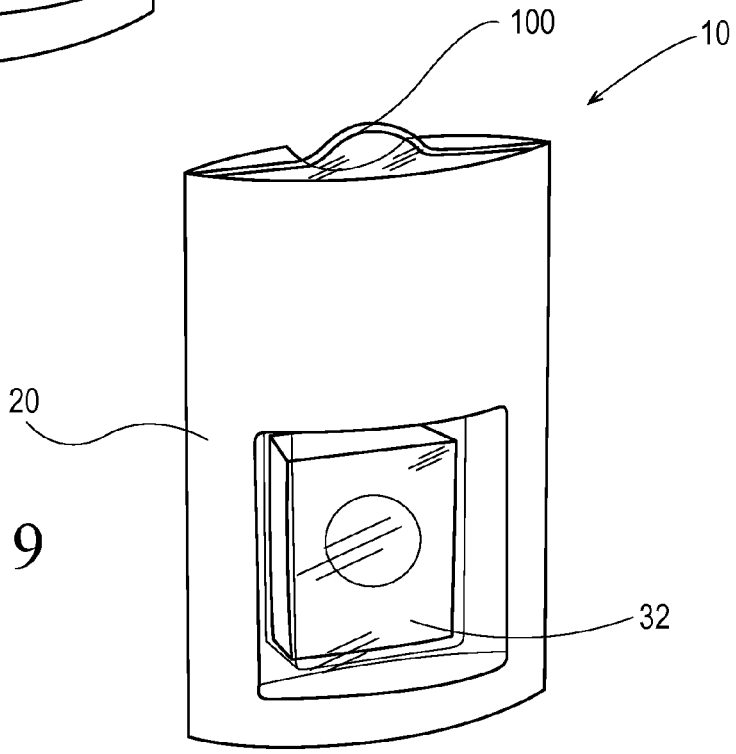
FIG. 9 is a perspective view of the assembled package wherein the inner container and cover are completely inserted into the outer sleeve according to one or more embodiments illustrated and described herein.

Regarding FIG. 6, the inner container 100 and cover 120 are shown in an assembled state with engagement areas 106 connected to receiving areas 105. Ridge 125 is also shown. Looking at FIG. 7, in order to assemble the final package 10, tooth treatment product 200 is placed inside of recess 130 of inner container 100 and cover 120 is placed partially over recess 130 and innter container 100 in order to secure the tooth treatment product in place. In one embodiment, the assembled inner container 100 is then partially slid into outer sleeve 20, such that the front face section 101 of inner container 100 is in contact with and facing the back panel 23 of sleeve 20, as shown in FIG. 8. As a result, back face section 102 of inner container 100 is in contact with and facing the front panel 22 of sleeve 20. As the inner container 100 is slid into sleeve 20, stop tab 33 remains folded over so that ridge 125 of the cover 120 does not engage the sleeve 20. As shown in FIG. 9, the inner container 100 is further slid into the outer sleeve 20 and is completely placed within the sleeve 20 such that the inner container 100 containing the tooth treatment product 200 is visible through window 32 in the outer sleeve 20.

Figure 10:
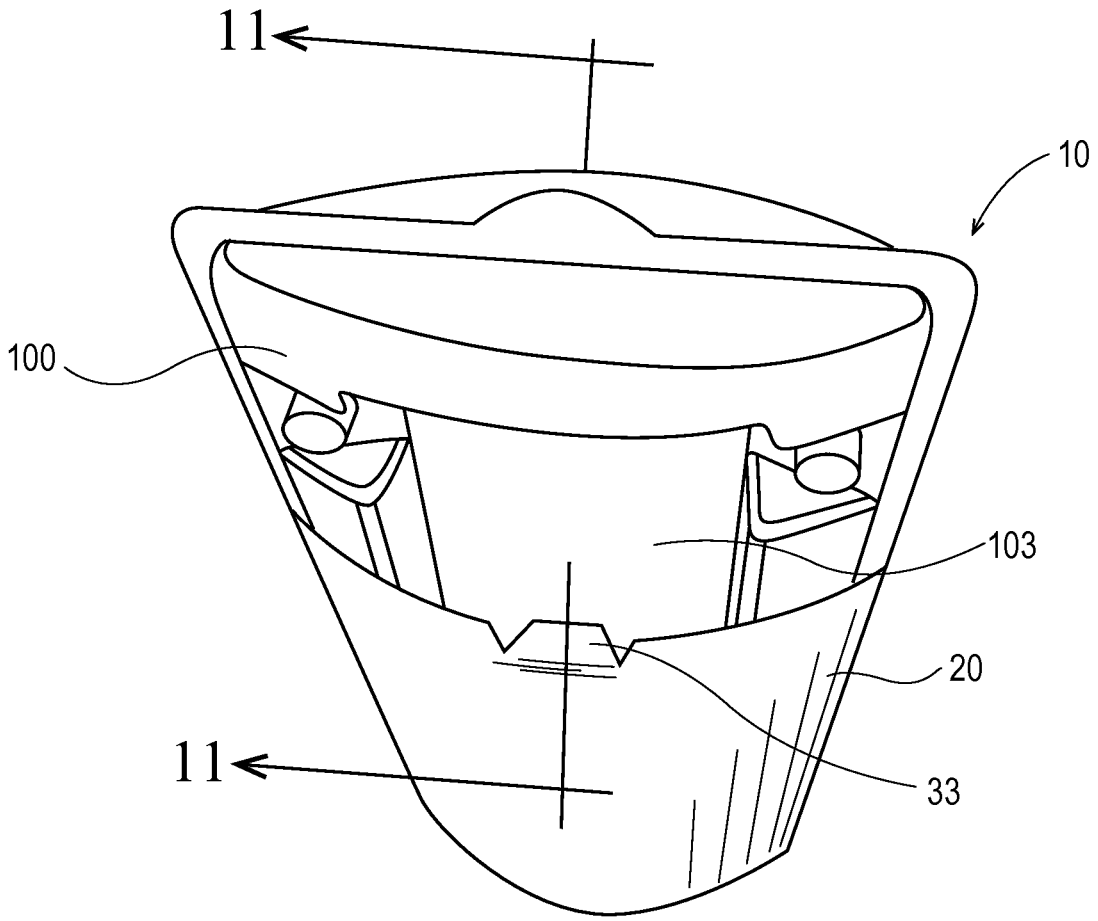
FIG. 10 is a perspective view of the inner container and cover partially inserted into the outer sleeve according to one or more embodiments illustrated and described herein.
Figure 11:
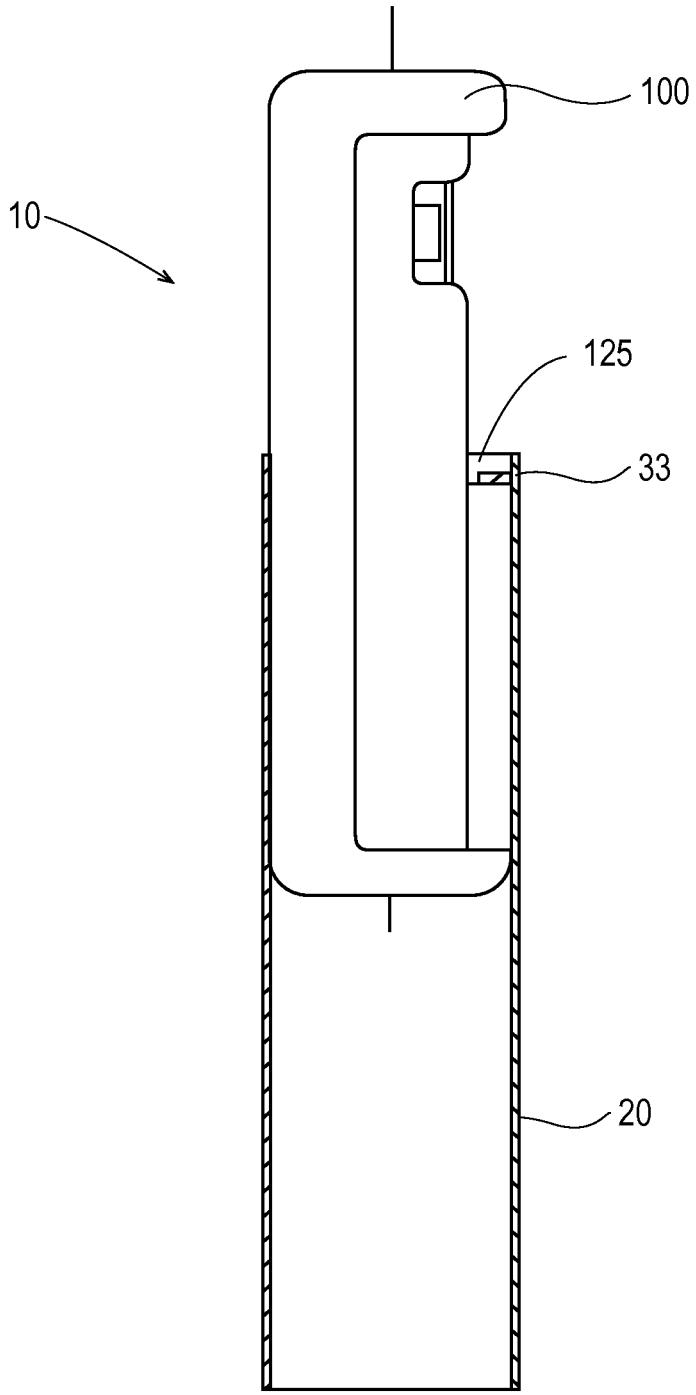
FIG. 11 is a cross-sectional side view of the stop tab of the outer sleeve engaging the ridge of the cover taken along line A-A of FIG. 10 according to one or more embodiments illustrated and described herein.

FIGS. 10 and 11 will now be referenced to explain how the stop tab 33 prevents the inner container 100 from easily being removed from the open end of the outer sleeve 20. In particular, FIG. 11 shows the stop tab 33 engaging or otherwise abutting the ridge 125 of the cover 120 to lock the inner container 100 within the outer sleeve 20 or otherwise prevent the inner container 100 from easily being removed therefrom. More particularly, the folded over portion of the stop tab 33 is folded over into the interior of the outer sleeve 20 and as the inner container 100 is slid out of the outer sleeve 20, the stop tab 33 catches the ridge 125 so that the inner container is stopped from being pulled out of the outer sleeve 20. When the stop tab 33 engages the ridge 125, about 30% to about 80% of the inner container is outside of the outer sleeve 20. Or, alternatively, about 20% to about 70% of the inner container remains within the outer sleeve 20. As a result, a user can access the tooth treatment product that is being held in recess 130, behind cover 120 without removing the entire inner container 100 from the sleeve 20. To remove the inner container 100 from the sleeve 20, a user can open or disengage stop tab 33 using a finger or in any other conventional manner.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A package for a tooth treatment product, comprising:

an inner container having a front face section and a back face section, the front face section including a recess portion therein for containing the tooth treatment product;

a cover joined to the front face section of the inner container, the cover having a height less than the corresponding height of the recess portion of the inner container, the difference in height defining a ridge between a top side of the cover and the recess portion;

an outer sleeve having at least one open end for receiving the inner container, the outer sleeve including a window through which the tooth treatment product is visible to a consumer; and a stop tab provided adjacent the at least one open end of the outer sleeve and configured to releasably engage the ridge;

wherein the inner container is removable through the at least one open end of the outer sleeve by disengaging the stop tab from the ridge.

2. The package according to claim 1, wherein the front face section includes one or more receiving areas and the back face section includes one or more engagement areas which engages the one or more receiving areas.

3. The package according to claim 1, wherein the front face section and the back face section, of the inner container are integrally formed.

4. The package according to claim 1, wherein the inner container is transparent.

5. The package according to claim 1, wherein the outer sleeve is manufactured from a blank.

6. The package according to claim 1, wherein the stop tab includes a flap integrally formed on one of the panels of the outer sleeve.

7. The package according to claim 1, wherein the stop tab extends from a back panel of the outer sleeve.

8. The package according to claim 7, wherein the stop tab extends in an inward direction from the at least one open end toward an interior space of the outer sleeve defined by a front panel and the back panel.

9. The package according to claim 1, wherein the window is positioned on the front panel of the outer sleeve.

10. The package according to claim 9 wherein the window is an opening in the outer sleeve.

* * * * *